US007967648B2

(12) United States Patent
Byrne

(10) Patent No.: US 7,967,648 B2
(45) Date of Patent: Jun. 28, 2011

(54) TERMINAL

(76) Inventor: Norman R. Byrne, Ada, MI (US)

( * ) Notice: Subject to any disclaimer, the term of this patent is extended or adjusted under 35 U.S.C. 154(b) by 0 days.

(21) Appl. No.: 12/580,011

(22) Filed: Oct. 15, 2009

(65) Prior Publication Data

US 2010/0210152 A1 Aug. 19, 2010

Related U.S. Application Data

(60) Provisional application No. 61/105,450, filed on Oct. 15, 2008.

(51) Int. Cl.
*H01R 11/22* (2006.01)

(52) U.S. Cl. ..... 439/856

(58) Field of Classification Search ..... 439/856, 439/861–862, 218, 682, 857
See application file for complete search history.

(56) References Cited

U.S. PATENT DOCUMENTS

| | | | | |
|---|---|---|---|---|
| 3,118,998 | A | 1/1964 | Mastney et al. | |
| 3,955,869 | A * | 5/1976 | Licht | 439/218 |
| 4,795,379 | A | 1/1989 | Sasaki | |
| 4,990,110 | A | 2/1991 | Byrne | |
| 6,932,660 | B2 * | 8/2005 | Roepke | 439/856 |

* cited by examiner

*Primary Examiner* — Edwin A. Leon
(74) *Attorney, Agent, or Firm* — Varnum LLP

(57) ABSTRACT

An electrical contact unit (200) is disclosed, having a series of four electrical receptacles (202, 204, 206, 208). Each of the receptacles includes an upper cantilever member (210) and a lower cantilever member (212). Upper lateral arms (214) are conductively interconnected by an upper bridge portion (216). Correspondingly, lower lateral arms (218) are conductively interconnected by a lower bridge portion (220). The upper lateral arms (214) and upper bridge portion (216) provide a pair of contact surfaces or edges (222). Correspondingly, the lower lateral arms (218) and lower bridge portion (220) form a pair of lower contact surfaces or edges (224). In addition, an upper cantilever member (228) positioned inwardly of the upper lateral arms (214) is also provided.

2 Claims, 9 Drawing Sheets

TERMINAL

CROSS-REFERENCE TO RELATED APPLICATIONS

This application is based on and claims priority of U.S. Provisional Application Ser. No. 61/105,450, filed Oct. 15, 2008.

STATEMENT REGARDING FEDERALLY SPONSORED RESEARCH OR DEVELOPMENT

Not Applicable.

PARTIES TO A JOINT RESEARCH AGREEMENT

Not Applicable.

REFERENCE TO A SEQUENCE LISTING

Not Applicable.

FIELD OF THE INVENTION

The invention relates generally to electrical terminals and, more particularly, to a multiple-contact configuration for electrical engagement of a blade terminal within a mating receptacle.

BACKGROUND OF THE INVENTION

Historically, various types of assemblies have been developed for electrically and conductively interconnecting devices to be electrically energized to sources of electrical power. For example, it is well known to provide various spatial areas of residential, commercial and industrial establishments with electrical receptacle units permanently (through fuses, circuit breakers or other emergency shut-off elements) conductively connected to one or more sources of main utility power. Each of the receptacle units typically comprises one or more engaging assemblies often referred to by the colloquial term "female receptacle."

These receptacle units are conventionally mounted in stationary walls or, alternatively, in the case of modern and modular office furniture systems, in moveable wall panels or even within work surfaces. Devices to be electrically energized often comprise receptacle plugs having two or more prongs or blade terminals adapted to be conductively engaged within the female receptacles. The prongs or blade terminals are conventionally referred to by the colloquial terms "male" plugs, prongs, blades or terminals. The receptacle plugs are typically interconnected to the circuitry of the device so as to be energized by wires extending through flexible insulative cords or the like. This type of male/female electrical interconnection configuration to provide removable or releasable conductive engagement is utilized in a myriad of electrical connector arrangements. For example, in addition to electrical energization of relatively large and discrete devices (such as lamps, televisions, stereos, typewriters, etc.), male/female interconnection configurations are also utilized internally in electrical devices such as computers and associated peripherals. In addition, male/female electrical interconnection arrangements are also utilized in a number of other applications, such as internal circuit wiring for electrical apparatus of modular office systems and the like.

In the design of male/female electrical interconnection configurations, it is of primary importance to provide a secure and stationary electrical contact between the conductive surfaces of the elements of the electrical receptacle and the conductive surfaces of the prongs or blade terminals. It is also of primary importance to provide surface connections having relatively little resistance. In view of the foregoing, various types of interfaces have been developed for engaging male prongs or blade terminals with mating female receptacles. For example, it is known to utilize an opposing pair of cantilever beams within the female receptacle, which provide a single point of contact on each side of an inserted male terminal. Other known arrangements include the use of single cantilever spring pressure, backed with a steel or similar spring supported within a plastic housing. This type of arrangement will conventionally provide a single point of contact at the electrical interface.

It has become known that it is preferable to provide as many interface points of contact as is reasonably possible, while still maintaining a releasable engagement. For example, an arrangement for providing four contact points is disclosed in Sasaki et al, U.S. Pat. No. 4,795,379 issued Jan. 3, 1989. The Sasaki et al patent refers to the concept that it has been known to utilize certain types of electrical connections in computers, telecommunications equipment and other data processing equipment, which are in the form of a receptacle contact having four resilient cantilever contact members extending forwardly from a base. The contact members are adapted to provide an electrical connection with a tab contact inserted from the front of the receptacle unit.

The tab contact is electrically engaged by four leaves from four directions. The four leaves can be arranged as opposing pairs, with each pair arranged orthogonally.

In this type of arrangement, electrical engagement is made with the tab contact at four points, thereby increasing reliability of the receptacle contact relative to a contact arrangement having only two contact points. Sasaki et al also explains that a problem can arise in that a possibility of an incomplete electrical engagement can be caused by foreign matter on the surface of the tab contact. In addition, one of the pairs of contact members may engage the edge surfaces of the tab contact. The edge surfaces of the tab contact are typically the surface edges formed when the contact is made by stamping a sheet of conductive material. The surfaces are often rough in comparison with the planar rolled or formed surface of the sheet, and thus have a lower contact reliability. Accordingly, these contact members may not provide a reliable electrical connection, and a greater insertion force may be required at the time of insertion.

As an improvement, Sasaki et al describes a receptacle contact having opposed leaf spring members formed by two parallel plates linked through a U-shaped portion extending between adjacent sides of the leaf spring members. The leaf spring members include first spring arms and second spring arms formed integrally with the spring members.

The first spring arms and second spring arms are opposed to each other, and outer contact and inner contact members are formed at the free ends of the spring arms, which are also opposed to each other. Additional contact members are located to the rear of the first set of contact members. The spring arms extend side by side from the leaf spring members, with the outer contact members being slightly twice the width of the inner contact members. The contact members are arcuate to facilitate insertion of a tab contact therebetween.

The receptacle contact described in Sasaki et al is formed by stamping from a suitable metal sheet having the desirable conductive and spring characteristics. The stamping process is performed by shaping the metal sheet in an appropriate configuration, and then folding the spring arms to the shape required, while folding another portion into a U-shape. In use, the tip of a tab contact can be inserted into the space between the outer contact members opposed to each other at the front portion of the receptacle contact. Upon insertion, upper and lower surfaces of the contact are brought into a wiping engagement with the outer contact members. Accordingly, foreign matter on upper and lower surfaces of the contact is removed. When the contact is inserted further, the upper and lower surfaces which have been cleaned by the outer contact members are also wipingly engaged by the inner contact members. In this manner, a relatively greater electrical connection reliability between the tab contact and the inner contact members is provided. In addition, the outer contact members and inner contact members are in electrical engagement with in upper and lower planar surfaces of the tab contact, and not with side surfaces which may comprise the cut edge surfaces of the contact. Accordingly, this decreases the force needed to insert the contact into the receptacle contact, thereby improving reliability of electrical connection.

In addition, the length of the spring arms which provide the contact force created between the outer contact members and the tab contact, is longer than the length of the spring arms which provide the contact force between inner contact members and the tab contact. Accordingly, the insertion force is reduced by reducing the contact force created between the tab contact and the outer contact members, which clean the upper and lower surfaces of the tab contact. In this manner, the initial insertion force of the tab contact within the outer contact members is less than the insertion force of the inner contact members.

SUMMARY OF THE INVENTION

In accordance with the invention, an electrical receptacle apparatus includes at least one electrical receptacle adapted to conductively engage a blade terminal or the like. The electrical receptacle includes upper means extending forwardly, with a lower surface having at least first, second and third upper contact locations formed thereon. Lower means are provided which extend forwardly and are conductively interconnected to and positioned substantially directly below the upper means. The lower means include an upper surface with at least first, second and third lower contact locations formed thereon. The receptacle is sized and configured so that the blade terminal is insertable between the upper means and the lower means. The blade terminal is adapted to conductively contact the receptacle at the first, second and third upper and lower contact locations, so as to form at least six conductive electrical contact locations with the receptacle.

Further in accordance with the invention, the first, second and third upper contact locations are formed substantially within a single upper plane, and form a triangular configuration within the upper plane. The first, second and third lower contact locations are formed substantially within a single lower plane, and form a triangular configuration within the lower plane.

The upper means includes at least one pair of upper lateral arms extending forwardly. An upper bridge portion is positioned transversely across forward portions of the upper lateral arms, and conductively interconnects the upper lateral arms. The upper bridge portion and the upper lateral arms form an upper spatial area. Upper cantilever means are positioned substantially within the upper spatial area, and have an arcuate shape forming the first upper contact location thereon.

The second and third upper contact locations are formed at interconnections of the upper bridge portion and the upper lateral arms. The lower surface of the upper means is formed of a lower surface of the upper cantilever means and lower surfaces of the upper bridge portion and upper lateral arms.

The lower means includes at least one pair of lower lateral arms extending forwardly. A lower bridge portion is positioned transversely across forward portions of the lower lateral arms, and conductively interconnects the lower lateral arms. The lower bridge portion and the lower lateral arms form a lower spatial area. Lower cantilever means are positioned substantially within the lower spatial area, and have an arcuate shape forming the first lower contact location thereon. The second and third lower contact locations are formed at interconnections of the lower bridge portion and the lower lateral arms. The upper surface of the lower means is formed of an upper surface of the lower cantilever means and upper surfaces of the lower bridge portion and lower lateral arms.

In accordance with another aspect of the invention, the receptacle apparatus can comprise four of the electrical receptacles. The apparatus can include a connecting beam central to and symmetrically located relative to the four receptacles. The connecting beam can be rectangular in configuration and integrally connected to each of a pair of secondary connecting portions through a pair of U-shaped connecting portions formed at ends of the connecting beam. Each of the secondary connecting portions forms an integral support portion for the upper means.

The upper means can include a pair of upper substantially parallel and elongated lateral arms extending forwardly. An upper 5 bridge portion can be conductively interconnected to the upper lateral arms. The upper bridge portion and the upper lateral arms can form an upper spatial area. An upper cantilever member can be provided which extends forwardly within the upper spatial area, with an arcuate shape forming a first upper contact location on a lower surface thereof. The upper bridge portion can be angled upwardly in a forward direction, and the upper lateral arms can be angled downwardly in a forward direction. Intersections of the upper bridge portion and the upper lateral arms can form the second and third upper contact locations. The upper cantilever member can be resilient in structure and comprise a rear downwardly angled portion integrally connected at a forward portion thereof to a forward upwardly angled portion. The first upper contact location can be formed at an interface of the rear downwardly angled portion and the forward upwardly angled portion.

BRIEF DESCRIPTION OF THE DRAWINGS

An illustrative embodiment of the invention will now be described with respect to the drawings, in which.

DETAILED DESCRIPTION OF THE PREFERRED EMBODIMENT

The principles of the invention will now be disclosed, by way of example, in an improved terminal 200 (and associated embodiments) as illustrated in FIGS. 10-27. However, prior to a detailed description of the improved terminal 200, a prior art electrical contact unit 100 will be described herein with respect to the illustrations shown in FIGS. 1-9. The electrical contact unit 100 was the subject of commonly owned U.S. Pat. No. 4,990,110 issued to Byrne, and dated Feb. 5, 1991. Following the description of the prior art electrical contact unit 100, the improved terminal 200 will be described.

The contact unit 100 as described herein provides at least six locations of contact with respect to the electrical engagement of male blade terminals with the electrical contact unit. In addition, the contact unit 100 also provides a triangular positioning of contact points so as to maintain a stable electrical connection between the blade terminals and the elements of the electrical receptacles.

Figure 1:
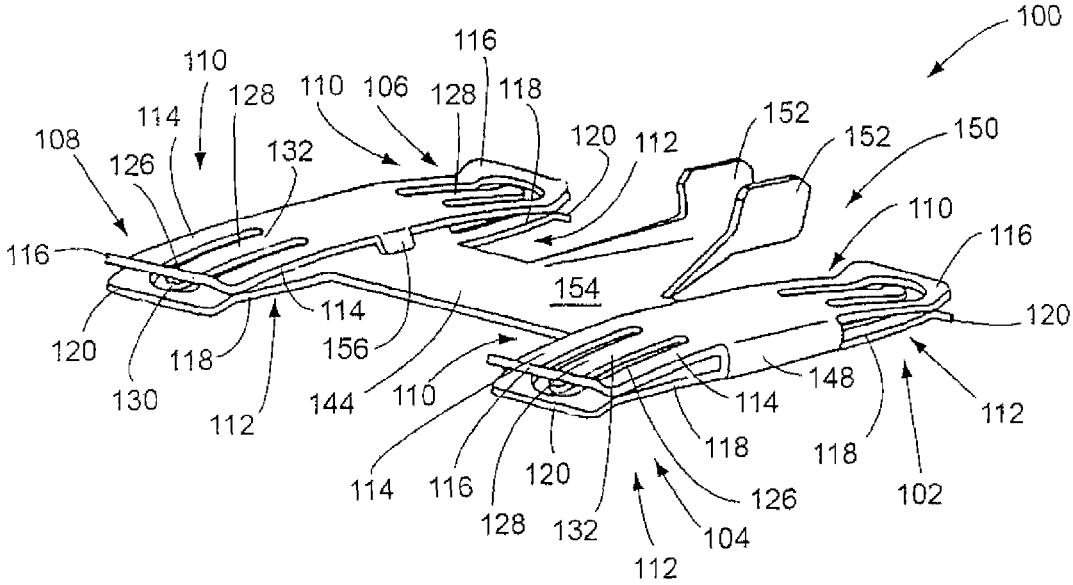
Fig. 1 (Prior Art)
FIG. 1 is a perspective view of a prior art electrical contact arrangement.

Referring primarily to FIG. 1, the electrical contact unit 100 includes a series of four electrical receptacles 102, 104, 106 and 108. As illustrated in FIGS. 1-6, each electrical receptacle 102, 104, 106 and 108 includes an outer, elongated and upper cantilever member 110, and an opposing lower cantilever member 112. The upper cantilever members 110 each include a pair of lateral and parallel elongated arms 114 integrally connected at their forward ends by a bridge portion 116. Correspondingly, each of the lower cantilever members 112 includes corresponding lateral arms 118 integrally connected at their forward ends by a lower bridge portion 120.

Figure 3:
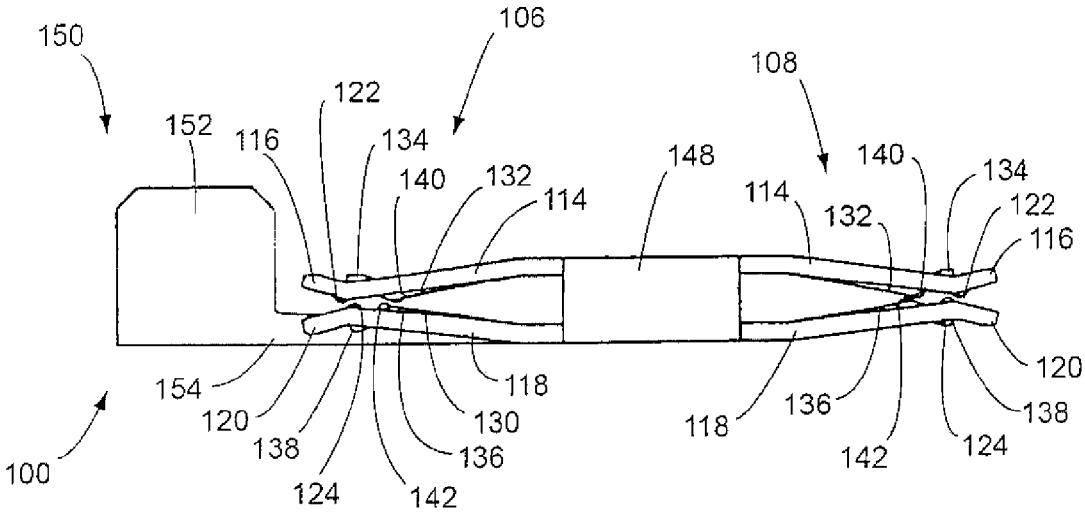
Fig. 3 (Prior Art)
FIG. 3 is a side view of the contact arrangement shown in FIG. 1.
Figure 4:
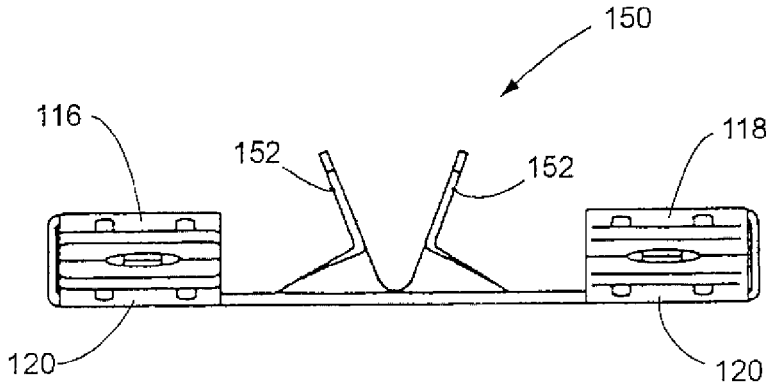
Fig. 4 (Prior Art)
FIG. 4 is an end view of the contact arrangement shown in FIG. 1.
Figure 6:
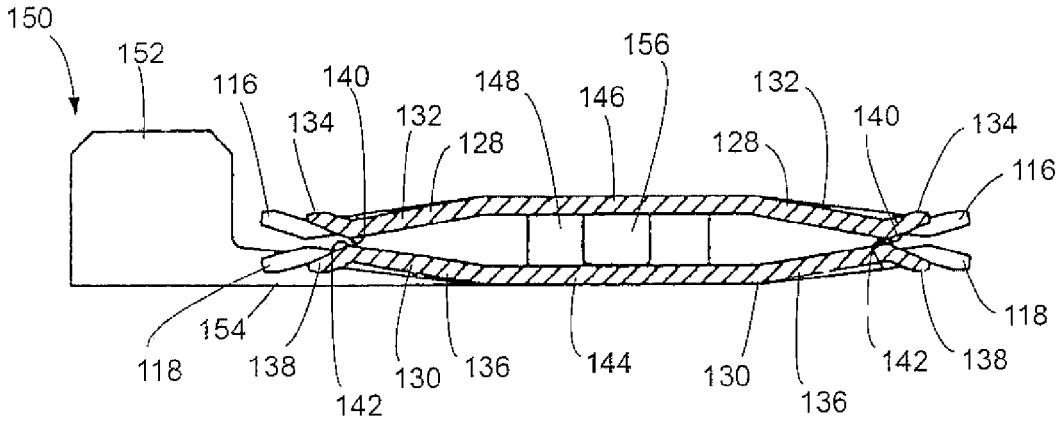
Fig. 6 (Prior Art)
FIG. 6 is a sectional view of the contact arrangement, taken along section lines 6-6 of FIG. 2.

As illustrated primarily in FIGS. 3 and 6, the upper lateral arms 114 have a slight downwardly angled configuration, while the upper bridge portion 116 is angled slightly upwardly. With this configuration, a contact surface or edge 122 is formed at the integral interface between the upper bridge portion 116 and each of the lateral arms 114. Correspondingly, the lateral arms 118 of the lower cantilever members 112, as further illustrated in FIGS. 3 and 6, are angled slightly upwardly, while the lower bridge portion 120 is angled slightly downwardly. With this configuration, a contact surface or edge 124 is provided at the interface between the integrally connected lateral arms 118 and lower bridge portion 120.

Figure 2:
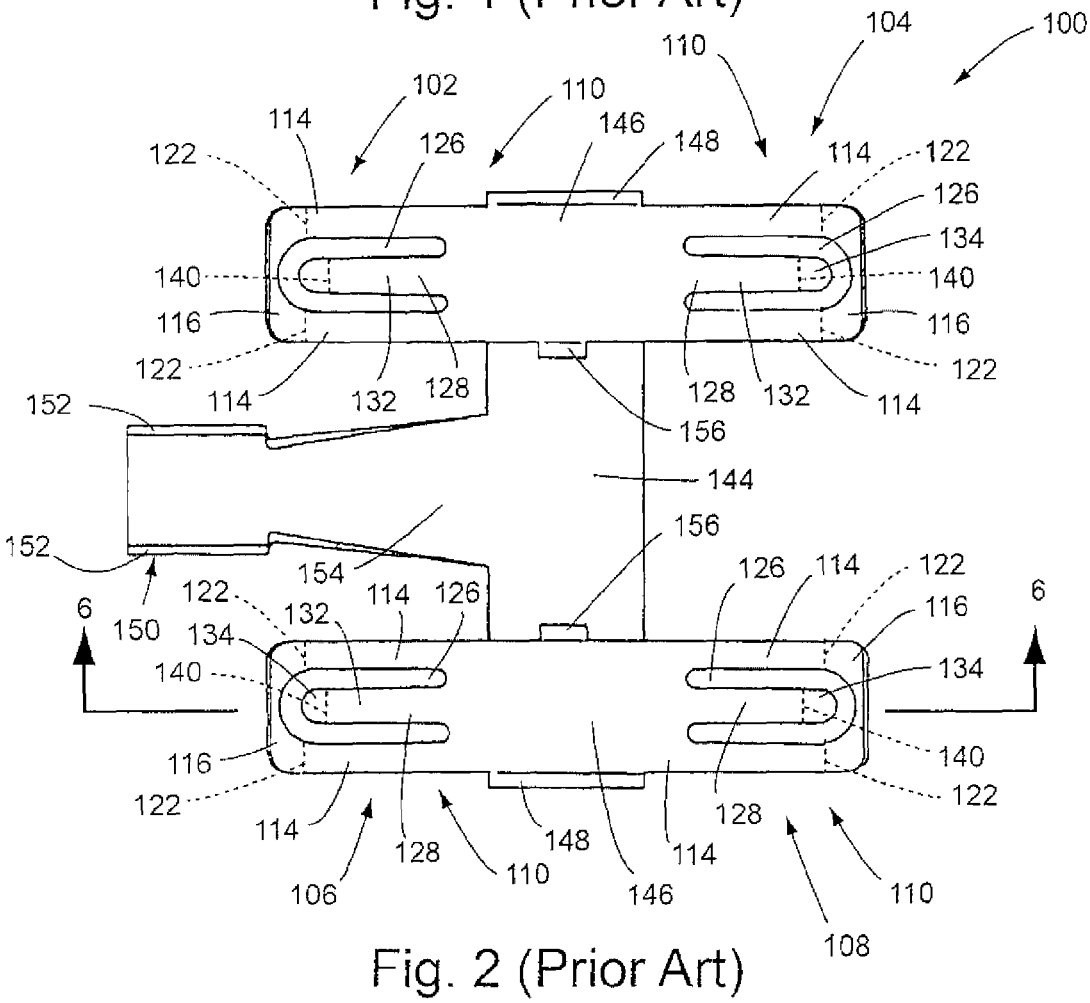
Fig. 2 (Prior Art)
FIG. 2 is a top plan view of the contact arrangement shown in FIG. 1.
Figure 5:
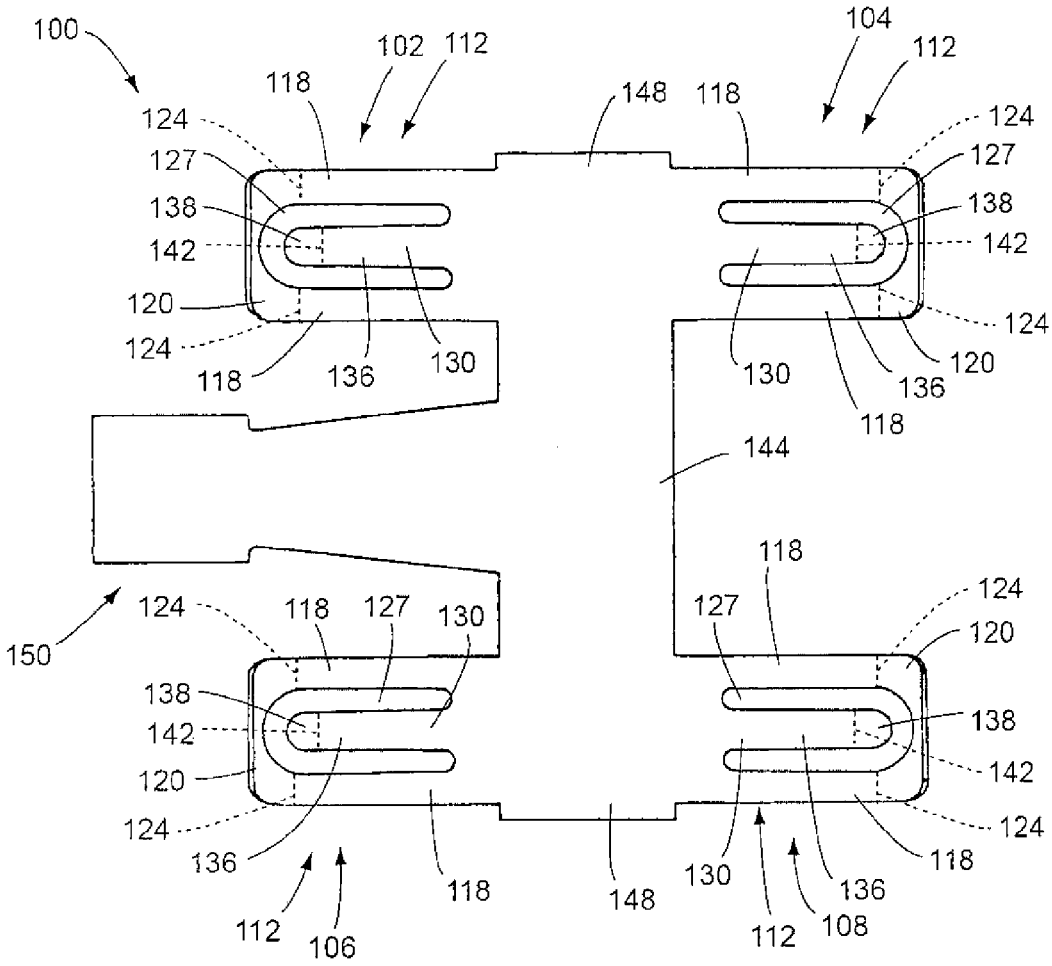
Fig. 5 (Prior Art)
FIG. 5 is an underside view from the opposing side of the contact arrangement shown in FIG. 2.

As shown primarily in FIGS. 2 and 5, the lateral arms 110 and bridge portion 116 of the upper cantilever members 110 form an arcuate spatial area 126 internal to the arms 114 and upper bridge portion 116. A similar spatial area 127 is formed by the lateral arms 118 and lower bridge portion 120 of the lower cantilever members 112. With respect specifically to FIG. 2, each of the receptacles 102, 104, 106 and 108 also include an inner and upper cantilever member 128 which extends forwardly within the spatial area 126 formed by the lateral arms 114 and bridge portion 116. An opposing inner cantilever member 130 is formed within the corresponding spatial area 127 of the lower cantilever members 112 and also extends forwardly. As illustrated primarily in FIGS. 3 and 6, each of the upper cantilever members 128 is resilient in structure and has a rear downwardly angled portion 132 integrally connected at the forward portion thereof to a forward upwardly angled portion 134. Correspondingly, each of the lower and inner cantilever members 130 includes a rear upwardly angled portion 136 integrally connected at its forward end to a forward downwardly angled portion 138. The interface between the rear downwardly angled portion 132 and forward upwardly angled portion 134 of the upper cantilever member 128 forms a contact surface or edge 140. Correspondingly, a contact surface or edge 142 is formed at the interface between the integrally connected rear upwardly angled portion 136 and forward downwardly angled portion 138 of the lower cantilever members 130.

The opposing upper and lower cantilever members 110, 112 and the opposing inner cantilever members 128, 130 are flexible and resilient in nature so as to be appropriately flexed when a male blade terminal (illustrated in FIGS. 7-9) is inserted between the opposing cantilever members. In addition, as will be further apparent from additional description herein, the contact surfaces 122 and 140 associated with the upper cantilever member 110 and the upper cantilever member 128 form a triangular contact surface configuration with the male blade terminal. Correspondingly, the contact surfaces 124 and 142 form an opposing triangular contact surface configuration, thereby providing six points of contact between the electrical receptacles 102, 104, 106 and 108 and the inserted male blade terminal. This triangular configuration provides a substantial stabilizing effect to the interconnection between the male blade terminal and the electrical receptacles, while correspondingly providing six points of contact. Referring again primarily to FIGS. 1, 2 and 5, the four-receptacle unit 100 includes a connecting beam 144 central to and symmetrically located relative to the receptacles 102, 104, 106 and 108. The connecting beam 144 is rectangular in configuration and is integrally connected to each of two secondary connecting portions 146 by means of a U-shaped connecting portion formed at each of the ends of the connecting beam 144. Each of the secondary connecting portions 146 also forms an integral inner support portion for the upper cantilever members 110 and the upper cantilever members 128.

As further illustrated in FIGS. 1, 2 and 5, the four-receptacle unit 100 includes a common terminal input channel 150 having a pair of crimp wings 152 integrally formed at the lateral sides of the channel 150. The channel 150 includes a transition portion 154 integrally connecting the common terminal input channel 150 with the connecting beam 144. In addition to the foregoing, the receptacle unit 100 also includes a pair of tabs 156 each formed on one side of each of the secondary connecting portions 146. These tabs 156 provide a means for controlling positioning of the "boxes" formed by the surfaces of the connecting beam 144, secondary connecting portions 146 and U-shaped connecting portions 148.

Figure 7:
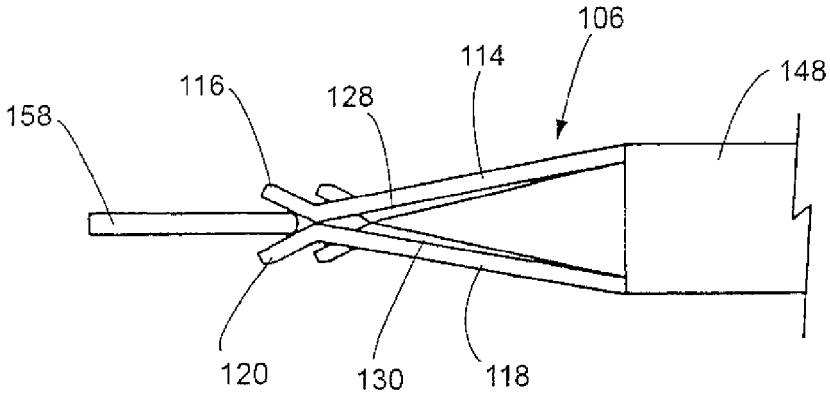
Fig. 7 (Prior Art)
FIG. 7 is a side view showing an example insertion arrangement of a blade terminal into the contact arrangement.
Figure 8:
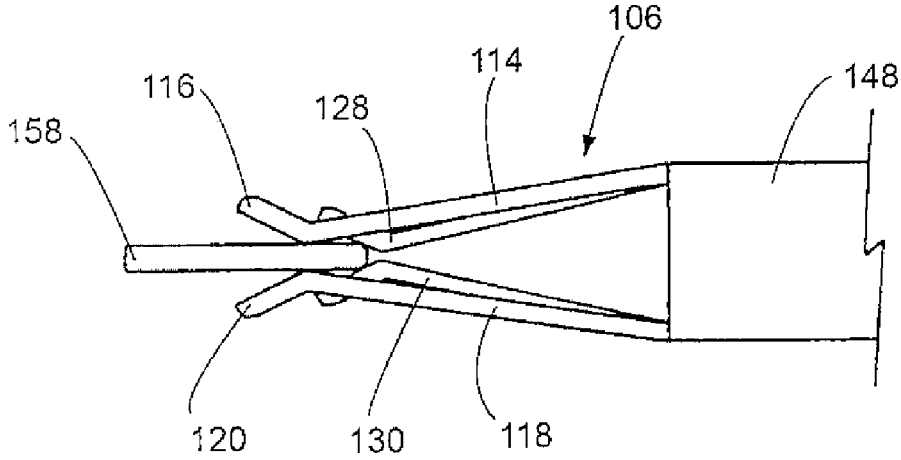
Fig. 8 (Prior Art)
FIG. 8 is an illustration similar to FIG. 7, showing further insertion of the blade terminal.
Figure 9:
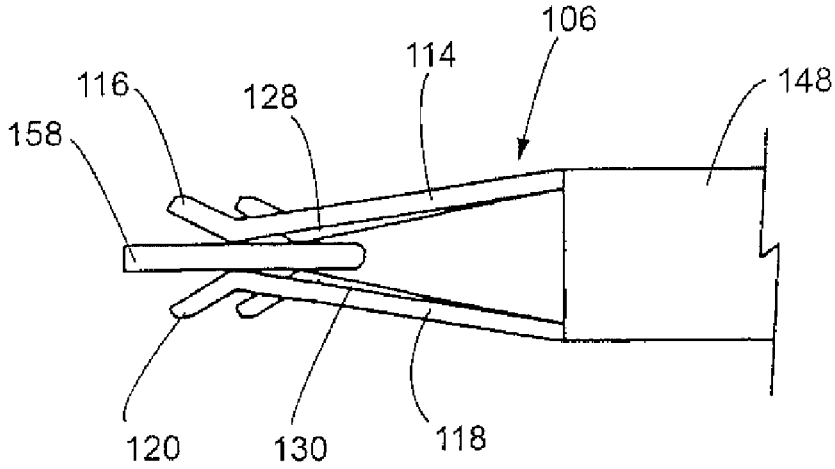
Fig. 9 (Prior Art)
FIG. 9 is an illustration similar to FIG. 8, showing final position insertion of the blade terminal.

The use of the electrical contact unit 100 with corresponding insertion of a male blade terminal 158 will now be described with respect to FIGS. 7-9. The male blade terminal or tab contact 158 may, as illustrated in FIGS. 7, 8 and 9, include tapered surfaces at its forward portion for purposes of facilitating insertion into the electrical receptacles 102, 104, 106 and 108. For purposes of illustration, FIGS. 7, 8 and 9 only illustrate one of the electrical receptacles 106. The forward portion of the blade terminal 158 is first inserted into the spatial area formed between the upper bridge portion 116 and lower bridge portion 120. As the blade terminal 158 is inserted, upper and lower surfaces of the terminal 158 will contact the upper contact surfaces 122 and lower contact surfaces 124 formed at the interface between the bridge portions 116, 118 and the lateral arms 114, 118. As the blade terminal 158 is further inserted, the forward portion of the terminal 158, at its upper and lower surfaces near the central portions thereof, will engage in an electrical contact with the contact surfaces 140, 142 formed at the interfaces of the integrally connected downwardly angled portion 132 and forwardly and upwardly angled portion 134 of the upper cantilever member 128, and the interface between the integrally connected upwardly angled portion 136 and downwardly angled portion 138.

As previously described, the upper contact surfaces 122 and 140 provide a triangular configuration, with three locations of electrical contact. This triangular configuration provides a substantial stabilizing effect which prevents relatively poor contact if the interconnection between the male blade terminal 158 and the corresponding receptacle is jarred or otherwise subjected to a "rocking" movement. Correspondingly, the three locations of lower contact provided by the contact surfaces 124 and 142 provide a corresponding triangular contact surface configuration opposing the upper contact configuration. With the three points of lower contact, the interconnection and engagement between the male blade terminal 158 and the corresponding electrical receptacle is provided with six locations of contact. Still further, if the male blade terminal 158 is appropriately sized relative to the relative positioning of the bridge portions 116, 120, the surfaces of the bridge portions 116, 120 will provide a "wiping" engagement with the central portion of the upper and lower surfaces of the blade terminal 158. This wiping engagement will ensure that the central portion of the blade terminal 158 which will be in electrical contact with the upper and inner cantilever member 128 and lower and inner cantilever member 130 will be free from any foreign matter as a result of the "cleaning" function carried out by the bridge portions 116, 118. With the six locations of contact provided for each of the electrical receptacles 102, 104, 106 and 108, the electrical, current-carrying capability of the receptacles is greatly improved. In addition, with respect to the particular four-receptacle unit 100 illustrated herein, four receptacles are provided with the necessity of only a single wire crimp configuration in an integral terminal, thereby providing an efficient use of space within a connector system. Still further, the triangular positioning of the three locations of contact on each of the upper and lower surfaces of the male blade terminal provide a substantially "steady" platform for the male blade terminal 158.

As apparent from the foregoing, the electrical connector unit 100 can be formed from a suitable metal sheet by means of stamping and forming the unit 100, with the sheet having the appropriate conductive and spring and resiliency characteristics. Such a stamping process can be achieved by utilizing a suitably formed metal sheet, and then folding over the elements forming the upper cantilever members 110 and the secondary connecting portions 146.

Figure 10:
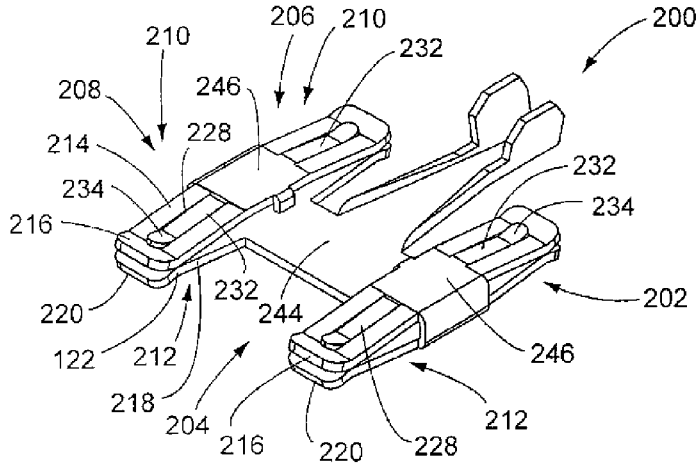
FIG. 10 is a perspective view of an improved terminal in accordance with the invention.

The improved terminal 200 in accordance with the invention will now be described primarily with respect to FIGS. 10-27. Referring first to FIG. 10, the improved terminal 200 includes a series of four electrical receptacles 202, 204, 206 and 208. As illustrated primarily in FIGS. 10 and 16-23, each electrical receptacle 102, 104, 106 and 108 includes an outer, elongated and upper cantilever member 210, and an opposing cantilever member 212. The upper cantilever members 210 each include a pair of lateral and parallel elongated arms 214 integrally connected at their forward ends by a bridge portion 216. Correspondingly, each of the lower cantilever members 212 includes corresponding lateral arms 218 integrally connected at their forward ends by a lower bridge portion 220.

As illustrated primarily in FIGS. 19, 21 and 24-27, the upper lateral arms 214 have a slight downwardly angled configuration, while the upper bridge portion 216 is angled slightly upwardly. With this configuration, a contact surface or edge 222 is formed at the integral interface between the upper bridge portion 216 and each of the lateral arms 214. Correspondingly, the lateral arms 218 of the lower cantilever members 212, as further illustrated in FIGS. 19, 21 and 24-27, are angled slightly upwardly, while the lower bridge portion 220 is angled slightly downwardly. With this configuration, a contact surface or edge 224 is provided at the interface between the integrally connected lateral arms 218 and lower bridge portion 220.

Figure 14:
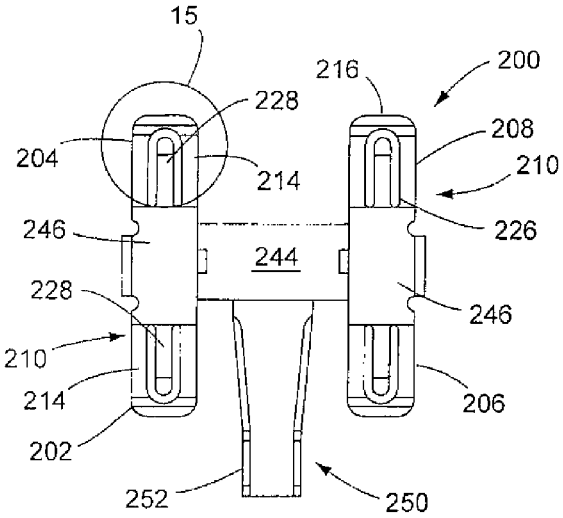
FIG. 14 is a plan view of the improved terminal shown in FIG. 10.
Figure 15:
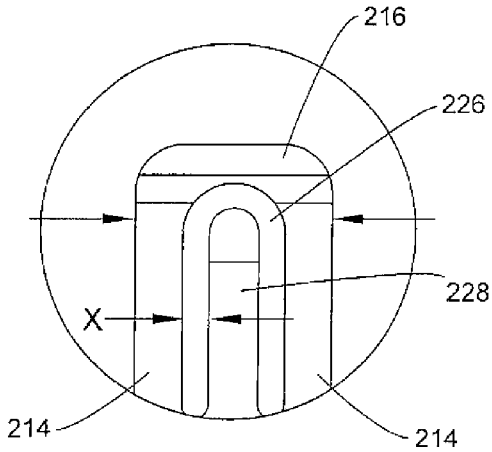
FIG. 15 is an enlarged view of a portion of the improved terminal shown in FIG. 14, and specifically directed to the portion of the terminal shown in circle 15 of FIG. 14.

As shown primarily in FIGS. 14 and 15, it is possible to utilize lateral arms, bridge portions and cantilever portions which form an arcuate spatial area 226 internal to the arms and upper bridge portion. A similar spatial area 227 can be formed by the lower lateral arms and the lower bridge portion of the lower cantilever members. This spatial area is illustrated as spatial area X in FIG. 15. It should be noted that with this spatial area, the width across the cantilever members is shown in FIG. 15 as width Y.

Figure 16:
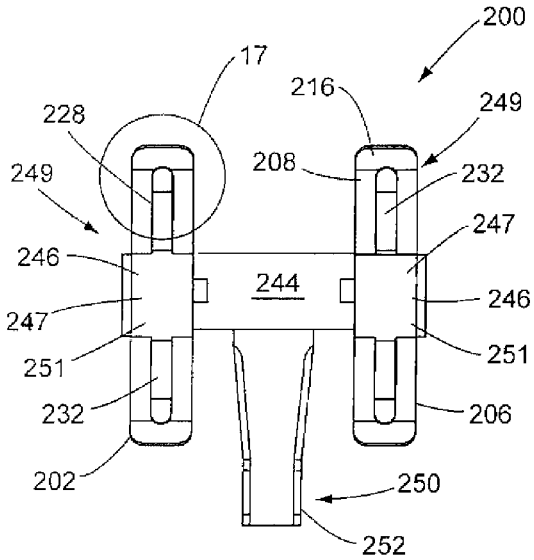
FIG. 16 is a plan view of the improved terminal shown in FIG. 10.
Figure 17:
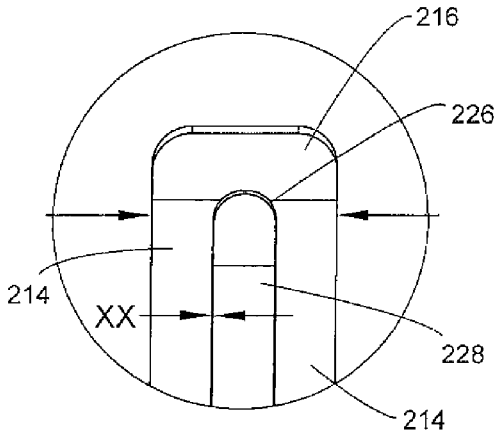
FIG. 17 is an enlarged, plan view of the portion of FIG. 16 identified as being within circle 17.
Figure 18:
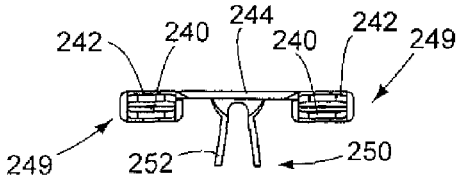
FIG. 18 is an upside down rear view of the improved terminal shown in FIG. 10.
Figure 19:
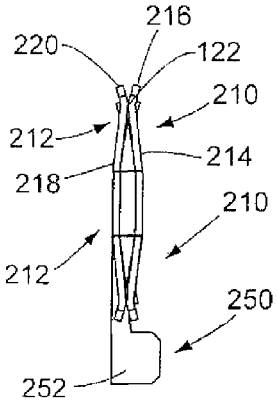
FIG. 19 is a left-side elevation view of the terminal shown in FIG. 18.
Figure 20:
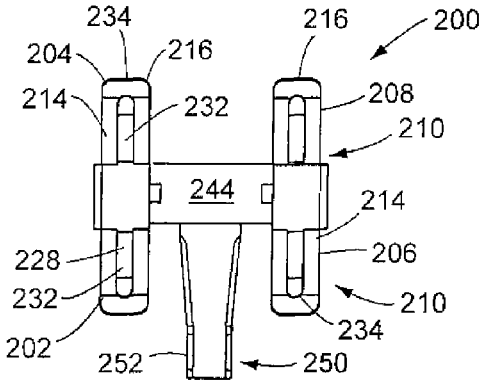
FIG. 20 is a plan view of the terminal shown in FIG. 18.
Figure 21:
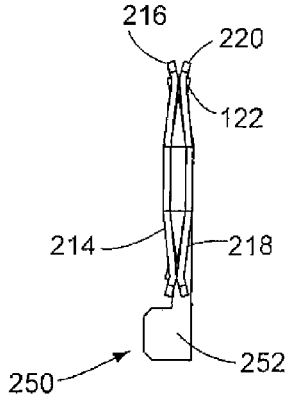
FIG. 21 is a right-side end view of the terminal shown in FIG. 18.
Figure 22:
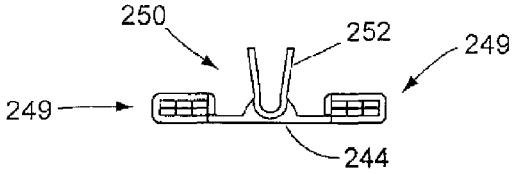
FIG. 22 is a front, elevation view of the terminal shown in FIG. 18.
Figure 23:
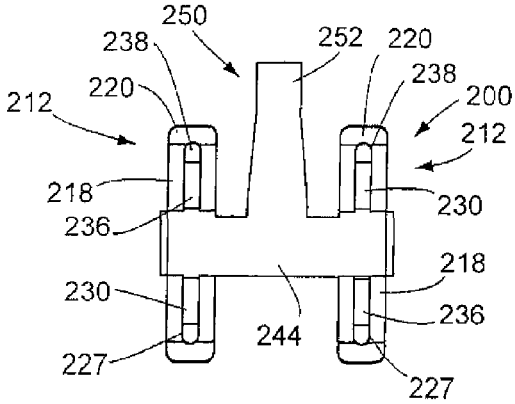
FIG. 23 is an underside view of the terminal shown in FIG. 18.
Figure 24:
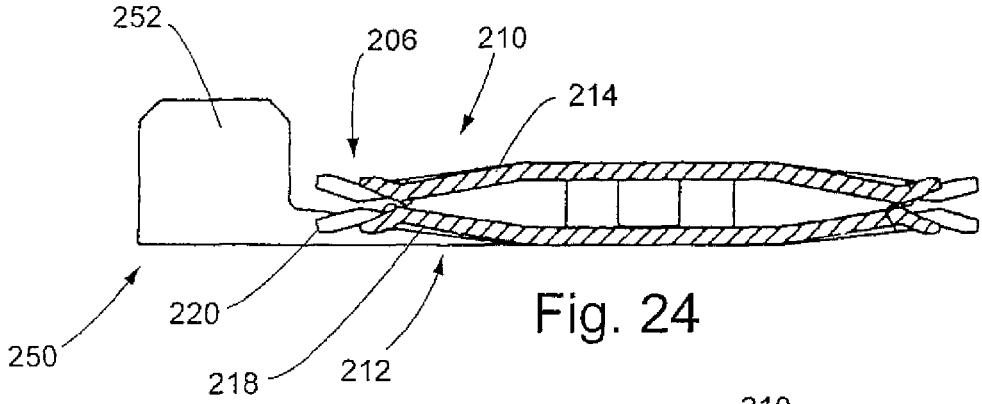
FIG. 24 is a sectional view of the terminal shown in FIG. 10, and taken from a side, elevation view.
Figure 25:
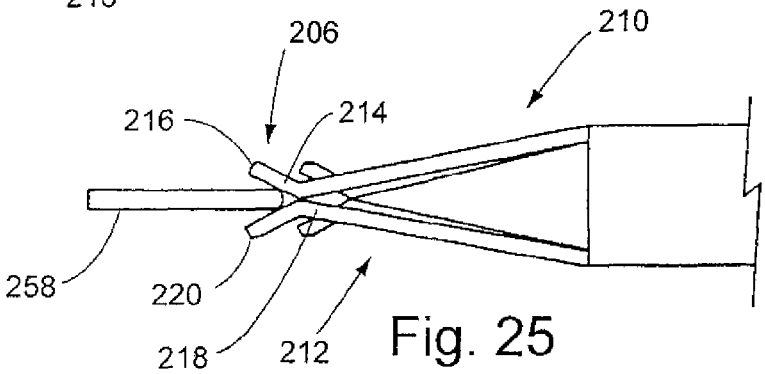
FIG. 25 is a partial side, elevation view showing the relative positioning of a terminal blade as it is being received within a female receptacle associated with the improved terminal.
Figure 26:
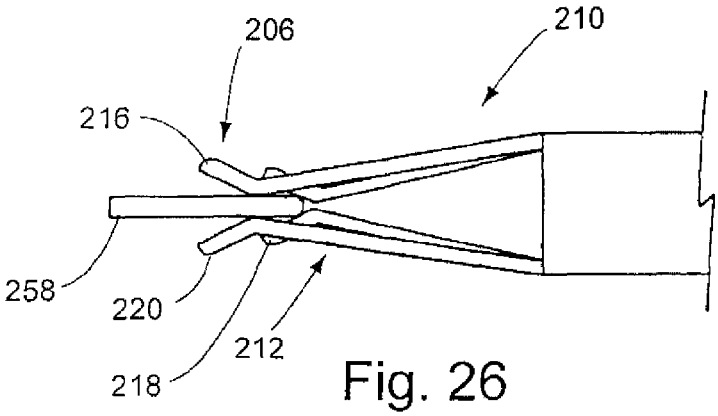
FIG. 26 is a partial side, elevation view similar to FIG. 25, but showing the terminal blade as being further inserted into the female receptacle.
Figure 27:
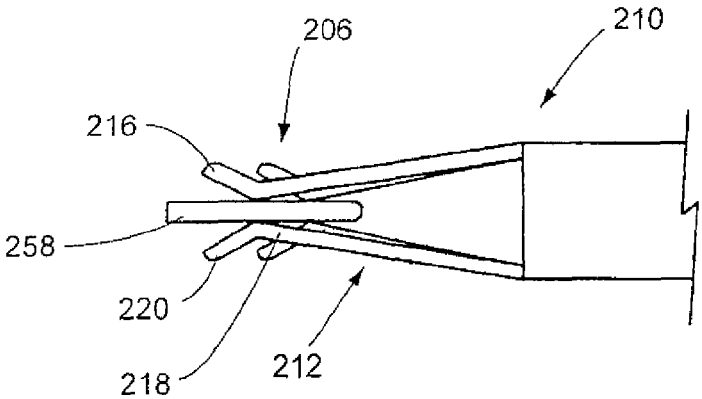
FIG. 27 is a partial side, elevation view similar to FIG. 26, but showing the terminal blade as being substantially fully inserted into the female receptacle.

In contrast, and as shown primarily in FIGS. 16 and 17, the lateral arms 210 and bridge portion 216 of the upper cantilever members 210 form an arcuate spatial area 226 internal to the arms 214 and upper bridge portion 216. A similar spatial area 227 is formed by the lateral arms 118 and lower bridge portion 220 of the lower cantilever members 212. Further, each of the receptacles 202, 204, 206 and 208 also include an inner and upper cantilever member 228 which extends forwardly within the spatial area 226 formed by the lateral arms 214 and bridge portion 216. An opposing inner cantilever member 230 is formed within the corresponding spatial area 227 of the lower cantilever members 212 and also extends forwardly. As illustrated primarily in FIGS. 24-27, each of the upper cantilever members 228 is resilient in nature and has a rear downwardly angled portion 232 integrally connected at the forward portion thereof to a forward upwardly angled portion 234. Correspondingly, each of the lower and inner cantilever members 230 includes a rear upwardly angled portion 236 integrally connected at its forward end to a forward downwardly angled portion 238. The interface between the rear downwardly angled portion 232 and forward upwardly angled portion 234 of the upper cantilever member 228 forms a contact surface or edge 240. Correspondingly, a contact surface or edge 242 is formed at the interface between the integrally connected rear upwardly angled portion 236 and forward downwardly angled portion 238 of the lower cantilever members 230. It should be noted that the spatial area shown as spatial area XX in FIG. 17 is less than spatial area X shown in FIG. 15. Also, the width Y shown in FIG. 15 is greater than the width YY shown in FIG. 17. With the configuration shown in FIGS. 15 and 17, less metal is required.

The opposing upper and lower cantilever members 210, 212 and the opposing inner cantilever members 228, 230 are flexible and resilient in nature, so as to be appropriately flexed when a male blade terminal (illustrated in FIGS. 25-27) is inserted between the opposing cantilever members. In addition, the contact surfaces 222 and 240 associated with the upper cantilever member 210 and the upper cantilever member 228 form a triangular contact surface configuration with the male blade terminal 258. Correspondingly, the contact surfaces 224 and 242 form an opposing triangular contact surface configuration, thereby providing 6 points of contact between the electrical receptacles 202, 204, 206 and 208 and the male blade terminal 258. This triangular configuration provides a substantial stabilizing effect to the interconnection between the male blade terminal and the electrical receptacles, while correspondingly providing 6 points of contact.

As shown in several of the drawings, the improved terminal 200 includes a connecting beam 244 central to and symmetrically located relative to the receptacles 202, 204, 206 and 208. The connecting beam 244 is rectangular in configuration, and is connected at its ends 247 to the side arms 249 through integral channel wraps 251. The channel wraps 251 are integral with the connecting beam 244 and form connecting and support pieces for the support arms 249.

As also shown in the drawings, the terminal 200 includes a common terminal input channel 250 having a pair of crimp wings 252 integrally formed at the lateral sides of the channel 250. The channel 250 includes a transition portion 254 integrally connecting the common terminal input channel 250 with the connecting beam 244. The terminal 100 also includes a pair of tabs 256, each formed on one side of the secondary connecting portions 246. These tabs 256 provide a means for controlling positioning of the "boxes" formed by the surfaces of the connecting beam 244, secondary connecting portions 246 and connecting portions 248.

With reference to FIGS. 24-27, the forward portion of the blade terminal 158 can first be inserted into the spatial area formed between the upper bridge portion 216 and lower bridge portion 220 of one of the receptacles. As the terminal 258 is inserted, upper and lower surfaces of the terminal 258 will contact the upper contact surfaces 222 and lower contact 224 formed at the interface between the bridge portions 216, 218 and the lateral arms 214, 218. As the blade terminal 258 is further inserted, the forward portion of the blade 258, at its upper and lower surfaces, will engage in an electrical contact with the contact surfaces 240, 242 formed at the interfaces of the downwardly angled portion 232 and upwardly angled portion 234 of the upper cantilever member 228, and the interface between the upwardly angled portion 236 and downwardly angled portion 238.

The contact surfaces 222, 240 provide a triangular configuration, with three locations of electrical contact. Three locations of lower contact are provided by the contact surfaces 224 and 242, in a corresponding triangular contact surface configuration. If appropriately sized, the surfaces of the bridge portions 216, 220 will form a "wiping" engagement with the central portion of the upper and lower surfaces of the blade terminal 258.

Figure 11:
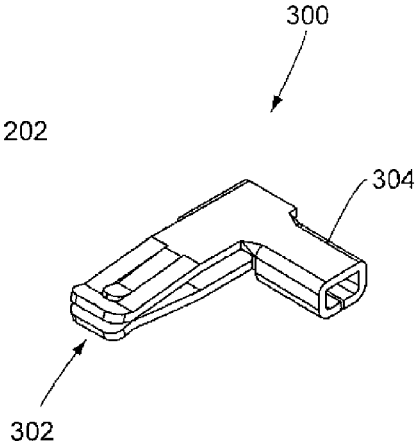
FIG. 11 is a second embodiment of an improved terminal in accordance with the invention.

A further embodiment of an improved terminal in accordance with the invention is shown as terminal 300 in FIG. 11. Therein, the terminal 300 includes a female terminal 302 having a configuration of cantilever members and similar elements substantially corresponding to one of the female receptacles 202-208. Further, however, the terminal 300 includes a right angle wire connector 304 adapted to receive an electrical wire or the like. The electrical wire or the like (not shown) can be suitably connected to the female receptacle 302 through appropriate crimping elements.

Figure 12:
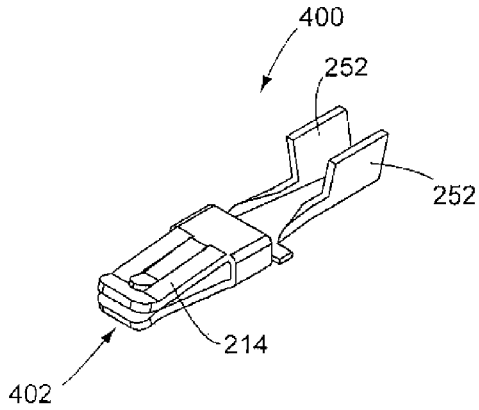
FIG. 12 is a third embodiment of an improved terminal in accordance with the invention.

A further embodiment of an improved terminal in accordance with the invention is shown as terminal 400 in FIG. 12. Terminal 400 includes a female receptacle 402, which can correspond to the female receptacle 202 associated with terminal 200. In this case, crimp wings 252 exist immediately behind the female receptacle 402, and are adapted to appropriately receive an electrical wire or the like for electrical contact with the components of the female receptacle 402.

Figure 13:
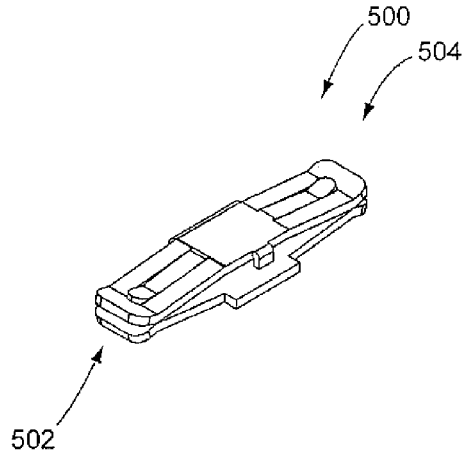
FIG. 13 is a fourth embodiment of an improved terminal in accordance with the invention.

Correspondingly, a further embodiment of a terminal in accordance with the invention is shown as terminal 500 in FIG. 13. In this case, the terminal 500 includes a first female receptacle 502 and a second female receptacle 504 positioned immediately behind the first female receptacle 502. If desired, power can be introduced to the terminal 500 through a male blade terminal (not shown) which can be inserted into either of the female receptacles 502 or 504.

It will be apparent to those skilled in the pertinent arts that other embodiments of terminals in accordance with the invention can be achieved. That is, the principles of terminals in accordance with the invention are not limited to the specific embodiments described herein. It will be apparent to those skilled in the art that modifications and other variations of the above-described illustrative embodiments of the invention may be effected without departing from the spirit and scope of the novel concepts of the invention.

The invention claimed is:

1. An electrical receptacle apparatus comprising at least one electrical receptacle adapted to conductively engage a blade terminal or the like, said electrical receptacle comprising:

a first, outer, elongated and upper cantilever member, and a second opposing cantilever member;

said first upper cantilever member comprises a pair of first lateral and parallel elongated arms integrally connected at their forward ends by a first bridge portion;

said second opposing cantilever member comprises a pair of second lateral and parallel elongated arms integrally connected at their forward ends by a second bridge portion;

said first pair of lateral and parallel elongated arms have a downwardly angled configuration, while said first upper bridge portion is angled slightly upwardly, with this configuration forming a contact surface or edge at an integral interface between said upper bridge portion and each of said first lateral and parallel elongated arms;

said second pair of lateral and parallel elongated arms of said second lower cantilever member are angled slightly upwardly, while said second lower bridge portion is angled slightly downwardly, and with this configuration forming a contact surface or edge at the interface between the second lateral arms and the second bridge portion;

said first lateral and parallel arms and said first bridge portion form an arcuate spatial area internal to said first arms and said first bridge portion;

said second lateral arms and said second bridge portion form a second arcuate spatial area internal to said second arms and to said second bridge portion; and said electrical receptacle apparatus further includes a right angle wire connector adapted to receive an electrical wire, and positioned at a right angle relative to an elongated configuration of said first cantilever member and said second cantilever member.

2. An electrical receptacle apparatus in accordance with claim 1, characterized in that said receptacle apparatus further includes a pair of crimp wings positioned immediately behind said first and said second cantilever members.

* * * * *